US009946177B2

(12) United States Patent
Murasawa et al.

(10) Patent No.: US 9,946,177 B2
(45) Date of Patent: Apr. 17, 2018

(54) CARRIER, TWO-COMPONENT DEVELOPER, IMAGE FORMING APPARATUS, PROCESS CARTRIDGE, AND IMAGE FORMING METHOD

(71) Applicants: Yoshihiro Murasawa, Shizuoka (JP); Koichi Sakata, Shizuoka (JP); Masashi Nagayama, Shizuoka (JP); Toyoaki Tano, Shizuoka (JP); Hiroyuki Kishida, Shizuoka (JP)

(72) Inventors: Yoshihiro Murasawa, Shizuoka (JP); Koichi Sakata, Shizuoka (JP); Masashi Nagayama, Shizuoka (JP); Toyoaki Tano, Shizuoka (JP); Hiroyuki Kishida, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/397,522

(22) Filed: Jan. 3, 2017

(65) Prior Publication Data

US 2017/0205721 A1 Jul. 20, 2017

(30) Foreign Application Priority Data

Jan. 18, 2016 (JP) ..... 2016-007239

(51) Int. Cl.

| | |
|---|---|
| ***G03G 9/113*** | (2006.01) |
| ***G03G 9/083*** | (2006.01) |
| ***G03G 15/08*** | (2006.01) |

(52) U.S. Cl.

CPC ..... *G03G 9/0831* (2013.01); *G03G 15/08* (2013.01); *G03G 15/0808* (2013.01); *G03G 2215/0607* (2013.01)

(58) Field of Classification Search

CPC . G03G 9/1131; G03G 9/1132; G03G 9/11363

See application file for complete search history.

(56) References Cited

U.S. PATENT DOCUMENTS

| | | | |
|---|---|---|---|
| 2003/0219670 | A1 | 11/2003 | Sawada et al. |
| 2004/0157147 | A1 | 8/2004 | Shiraishi et al. |
| 2004/0229143 | A1 | 11/2004 | Umemura et al. |
| 2004/0234879 | A1 | 11/2004 | Hasegawa et al. |
| 2005/0026064 | A1 | 2/2005 | Sugiura et al. |
| 2005/0089786 | A1 | 4/2005 | Sugiura et al. |
| 2005/0089787 | A1 | 4/2005 | Uchinokura et al. |
| 2005/0208408 | A1 | 9/2005 | Uchinokura et al. |
| 2005/0277046 | A1 | 12/2005 | Sawada et al. |
| 2006/0029433 | A1 | 2/2006 | Saito et al. |

(Continued)

FOREIGN PATENT DOCUMENTS

| | | |
|---|---|---|
| JP | 41-020153 | 11/1966 |
| JP | 42-001627 | 1/1967 |

(Continued)

OTHER PUBLICATIONS

Translation of JP 2002-179948 published Jun. 2002.*

*Primary Examiner* — Peter L Vajda

(74) *Attorney, Agent, or Firm* — Oblon, McClelland, Maier & Neustadt, L.L.P.

(57) ABSTRACT

A carrier is provided. The carrier includes a magnetic core particle and a resin layer coating a surface of the magnetic core particle. The resin layer includes a resin, a conductive particle including tungsten tin oxide, and a chargeable filler.

18 Claims, 1 Drawing Sheet

(56) References Cited

U.S. PATENT DOCUMENTS

| | | | | |
|---|---|---|---|---|
| 2006/0063081 | A1 | 3/2006 | Nagatomo et al. | |
| 2006/0204883 | A1 | 9/2006 | Nakayama et al. | |
| 2006/0240351 | A1 | 10/2006 | Sugiura et al. | |
| 2007/0031748 | A1 | 2/2007 | Kotsugai et al. | |
| 2007/0190444 | A1 | 8/2007 | Kotsugai et al. | |
| 2008/0014527 | A1 | 1/2008 | Kotsugai et al. | |
| 2008/0213682 | A1 | 9/2008 | Saitoh et al. | |
| 2008/0268366 | A1 | 10/2008 | Nakayama et al. | |
| 2009/0214966 | A1 | 8/2009 | Kishida | |
| 2009/0297973 | A1 | 12/2009 | Iwamoto et al. | |
| 2011/0170915 | A1 | 7/2011 | Aoki et al. | |
| 2012/0237868 | A1 | 9/2012 | Yamada et al. | |
| 2012/0251168 | A1 | 10/2012 | Nagayama et al. | |
| 2013/0244162 | A1 | 9/2013 | Yamada et al. | |
| 2013/0260299 | A1 | 10/2013 | Nakajima et al. | |
| 2013/0260302 | A1 | 10/2013 | Nakajima et al. | |
| 2014/0080052 | A1 | 3/2014 | Yaguchi et al. | |
| 2014/0227638 | A1 | 8/2014 | Kishida et al. | |
| 2014/0248557 | A1* | 9/2014 | Yaguchi | G03G 9/1075 430/111.35 |
| 2015/0030819 | A1 | 1/2015 | Naito et al. | |
| 2015/0153665 | A1 | 6/2015 | Kishida et al. | |
| 2015/0253685 | A1 | 9/2015 | Suzuki et al. | |
| 2016/0327884 | A1 | 11/2016 | Nakajima et al. | |
| 2016/0363880 | A1 | 12/2016 | Takii et al. | |

FOREIGN PATENT DOCUMENTS

| | | | | |
|---|---|---|---|---|
| JP | 43-027596 | | 11/1968 | |
| JP | 44-006397 | | 3/1969 | |
| JP | 45-026478 | | 9/1970 | |
| JP | 53-127726 | | 11/1978 | |
| JP | 55-127589 | | 10/1980 | |
| JP | 55-157751 | | 12/1980 | |
| JP | 56-140358 | | 11/1981 | |
| JP | 57-096355 | | 6/1982 | |
| JP | 57-096356 | | 6/1982 | |
| JP | 57-167033 | | 10/1982 | |
| JP | 58-207054 | | 12/1983 | |
| JP | 61-110161 | | 5/1986 | |
| JP | 62-273576 | | 11/1987 | |
| JP | 7-140723 | | 6/1995 | |
| JP | 8-179570 | | 7/1996 | |
| JP | 8-286429 | | 11/1996 | |
| JP | 2002-179948 | * | 6/2002 | G03G 9/08 |
| JP | 2006-079022 | | 3/2006 | |
| JP | 2008-262155 | | 10/2008 | |
| JP | 2009-186769 | | 8/2009 | |
| JP | 2009-251483 | | 10/2009 | |
| JP | 2014-029464 | | 2/2014 | |
| JP | 2014-215484 | | 11/2014 | |

* cited by examiner

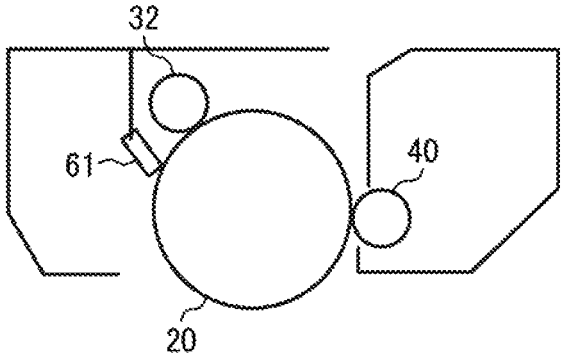
32
61
40
20

CARRIER, TWO-COMPONENT DEVELOPER, IMAGE FORMING APPARATUS, PROCESS CARTRIDGE, AND IMAGE FORMING METHOD

CROSS-REFERENCE TO RELATED APPLICATION

This patent application is based on and claims priority pursuant to 35 U.S.C. § 119(a) to Japanese Patent Application No. 2016-007239, filed on Jan. 18, 2016, in the Japan Patent Office, the entire disclosure of which is hereby incorporated by reference herein.

BACKGROUND

Technical Field

The present disclosure relates to a carrier, a two-component developer, an image forming apparatus, a process cartridge, and an image forming method.

Description of the Related Art

In a typical electrophotographic image forming process, an electrostatic latent image is formed on an electrostatic latent image bearer and then developed into a toner image with a developer. The toner image is transferred onto a recording medium, fixed thereon, and output as a printed matter.

The developer generally includes a toner and a carrier. A typical carrier is composed of a core material and a resin layer that is coating the core material. Conventionally, the resin layer is formed of low-surface-energy resins, such as fluororesin and silicone resin, for the purpose of extending the lifespan of the carrier. Such a resin layer forms of a uniform surface of the carrier, which prevents the occurrence of toner filming, an oxidization of the surface, a decrease in humidity resistance, and an adhesion of the carrier to a surface of a photoconductor, while extending the lifespan of the developer, protecting the surface of the photoconductor from scratch and abrasion, controlling charge polarity, and adjusting the amount of charge.

In accordance with recent demands for higher printing speed, reduction of environmental burden of wastes, and reduction of printing cost per sheet, there is a need for a highly-durable carrier.

Among various properties of the carrier, a resistance value is adjusted depending on the image forming system used in combination with the carrier, for achieving a target printing quality. One method of adjusting the resistance value involves including a conductive particle in the resin layer of the carrier. Examples of the conductive particle generally include carbon black, titanium oxide, zinc oxidize, and ITO (indium tin oxide). In particular, single-particle carbon black and ITO-coated particle have been reported as the conductive particle having excellent conductivity.

With respect to ITO-coated particle, ITO is required to be in the form of a thin coating film (hereinafter "conductive coating film") on the surface of the base particle, for adjusting conductivity. When such an ITO-coated particle is used as the conductive particle in a carrier, however, since each carrier particle collides with the other carrier particles in a developing device, the conductive coating films of the ITO-coated particles which are exposed at the surface of the carrier particle are scraped off. Since the conductive coating film is thin, the base particle is exposed at the surface of the carrier particle in the early stage. As a result, the resin layer of the carrier rapidly weakens in terms of impact resistance, thereby accelerating an abrasion of the resin layer, a reduction of the resistance, an occurrence of carrier scattering, and shortening the lifespan of the carrier.

In view of this situation, there has been an attempt to more thickening the conductive coating film to delay an exposure of the base particle. However, this attempt does not prevent an abrasion of the conductive coating film.

On the other hand, the resin layer of the carrier may further include a conductive filler for giving conductivity to the carrier. Examples of the conductive filler generally include carbon black, available at a low price. Carbon black as the conductive filler, however, cannot respond to recent demands for higher printing speed, improved stress resistance, and an extended lifespan, because of causing a color contamination problem when the carrier is used in combination with a colored toner (especially yellow toner), white toner, or transparent toner.

Other examples of the conductive filler include those having a core-shell structure, in which the core and the shell respectively serve as the base particle and the conductive coating film. Such a core-shell-type conductive filler secures temporal charging ability of the carrier as the base particle is gradually exposed after the conductive coating film has been abraded. However, the core-shell type conductive filler has a drawback that the temporal charging ability fluctuates depending on the degree of abrasion of the conductive coating film (or the degree of exposure of the base particle). There is a demand for a carrier that more reliably provides temporal charging ability.

SUMMARY

In accordance with some embodiments of the present invention, a carrier is provided. The carrier includes a magnetic core particle and a resin layer coating a surface of the magnetic core particle. The resin layer includes a resin, a conductive particle including tungsten tin oxide, and a chargeable filler.

In accordance with some embodiments of the present invention, a two-component developer is provided. The two-component developer includes the above carrier and a toner.

In accordance with some embodiments of the present invention, an image forming apparatus is provided. The image forming apparatus includes an electrostatic latent image bearer, a charger, an irradiator, a developing device, a transfer device, and a fixing device. The charger charges the electrostatic latent image bearer. The irradiator irradiates the charged electrostatic latent image bearer with light to form an electrostatic latent image thereon. The developing device develops the electrostatic latent image formed on the electrostatic latent image bearer with the above developer to form a toner image. The transfer device transfers the toner image from the electrostatic latent image bearer onto a recording medium. The fixing device fixes the toner image on the recording medium.

In accordance with some embodiments of the present invention, a process cartridge that is detachably mountable on an image forming apparatus is provided. The process cartridge includes an electrostatic latent image bearer, a charger, a developing device, and a cleaner. The charger charges the electrostatic latent image bearer. The developing device develops an electrostatic latent image formed on the electrostatic latent image bearer with the above developer to form a toner image. The cleaner cleans the electrostatic latent image bearer.

In accordance with some embodiments of the present invention, an image forming method is provided. The image forming method includes: forming an electrostatic latent image on an electrostatic latent image bearer; developing the electrostatic latent image formed on the electrostatic latent image bearer with the above developer to form a toner image; transferring the toner image from the electrostatic latent image bearer onto a recording medium; and fixing the toner image on the recording medium.

BRIEF DESCRIPTION OF THE DRAWING

A more complete appreciation of the disclosure and many of the attendant advantages thereof will be readily obtained as the same becomes better understood by reference to the following detailed description when considered in connection with the accompanying drawing. The accompanying drawing shows a schematic view of a process cartridge according to an embodiment of the present invention. This exemplary process cartridge includes a photoconductor 20 serving as an electrostatic latent image bearer, a charger 23 for charging the photoconductor 20, a developing device 40, and a cleaner 61. The accompanying drawing should not be interpreted to limit the scope of the present invention. The accompanying drawing is not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, a carrier having superior temporal stability and durability is provided.

The carrier according to an embodiment of the present invention includes a magnetic core particle and a resin layer coating a surface of the magnetic core particle. The resin layer includes a resin, a conductive particle, and a chargeable filler. The conductive particle includes tungsten tin oxide.

As the magnetic core particle, materials conventionally used for carriers for electrophotographic two-component developers can be used, such as ferromagnetic metals (e.g., iron, cobalt), iron oxides (e.g., magnetite, hematite, ferrite), alloys, and resin particles in which magnetic materials are dispersed. Among these materials, Mn ferrite, Mn—Mg ferrite, and Mn—Mg—Sr ferrite are preferable because they are environmentally-friendly. Specific examples of the magnetic core particle include, but are not limited to, commercially-available products such as MPL-35S and MFL-35HS (available from Powdertech Co., Ltd.); and DFC-400M, DFC-410M and SM-350NV (available from Dowa IP Creation Co., Ltd.).

Preferably, the volume average particle diameter of the magnetic core particle is 20 μm or more for preventing the carrier from depositing or scattering, and is 100 μm or less for preventing a generation of abnormal images (e.g., stripe-like image) and deterioration of image quality. In particular, magnetic core particles having a volume average particle diameter of from 20 to 60 μm can meet a recent demand for higher image quality. The volume average particle diameter can be measured by a Microtrac particle size analyzer HRA9320-X100 (available from Nikkiso Co., Ltd.).

Preferably, the magnetic core particle (hereinafter "core particle" for simplicity) has a shape factor SF2 in the range of from 120 to 160 and an arithmetic mean roughness Ra in the range of from 0.5 to 1.0 μm. Such a core particle having a specific shape can provide a carrier having superior temporal charge stability and resistance stability. Such a core particle having the specified shape factor SF2 and arithmetic mean roughness Ra is considered to have a proper surface irregularity. Owing to the surface irregularity, the carrier is prevented from undergoing charge decrease and/or resistance increase, which may be caused when a spent toner is adhered to the carrier, since the surface irregularity removes the spent toner off from the carrier. When the shape factor SF2 is less than 120, the core particle becomes a nearly true sphere without a proper surface irregularity, which is difficult to remove off the spent toner. When the shape factor SF2 is in excess of 160, after a long-term use of the carrier in a developing device, the core particle may be excessively exposed at the surface of the carrier, causing a large change in resistance value of the carrier. Thus, the amount and condition of toner on an electrostatic latent image bearer is also changed, making the image quality unstable.

The shape factors SF1 and SF2 can be determined by, for example, imaging 100 randomly-selected core particles with a field emission scanning electron microscope (FE-SEM S-800 available from Hitachi, Ltd.) at a magnification of 300 times, analyzing the image with an image analyzer (LUZEX AP available from Nireco Corporation) through an interface, and calculating from the following formulae (1) and (2).

$$SF1=(L^2/A)\times(\pi/4)\times100 \quad (1)$$

$$SF2=(P^2/A)\times(1/4\pi)\times100 \quad (2)$$

In the formulae (1) and (2), L represents the absolute maximum length of a projected image of a core particle (i.e., the diameter of the circumscribed circle of the projected image), P represents the perimeter of the projected image, and A represents the area of the projected image.

The shape factor SF1 represents the degree of roundness of a particle. The shape factor SF2 represents the degree of concavity and convexity of a particle. A particle having a shape far from a sphere has a large SF1 value. A particle having an undulating surface has a large SF2 value.

In the present disclosure, the arithmetic mean roughness Ra is measured by imaging one core particle with a microscope (OPTELICS C130 available from Lasertec Corporation) at an object lens magnification of 50 times and a resolution of 0.20 μm, within a square observing area with each side having a length of 10 μm and extending from an apical part of the core particle. This measurement procedure is applied to 100 core particles.

The resin layer that is coating a surface of the core particle includes, as described above, a resin, a conductive particle, and a chargeable filler.

Specific examples of the resin include, but are not limited to, cross-linked products, silicone resins, acrylic resins, and combinations thereof.

One example of the cross-linked products is obtained by subjecting a copolymer including structural units represented by the following formulae (A) and (B) to a hydrolysis to generate silanol groups, and thereafter a condensation.

Formula (A)

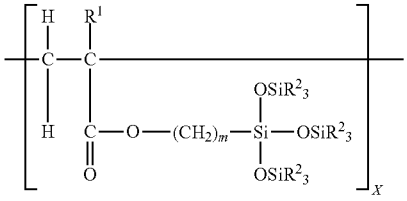

In the formula (A), $R^1$ represents a hydrogen atom or methyl group, $R^2$ represents an alkyl group having 1 to 4 carbon atoms, m represents an integer of from 1 to 8, and X represents a molar percent of from 10 to 90.

Formula (B)

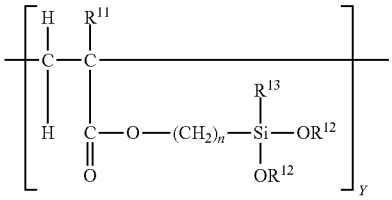

In the formula (B), $R^{11}$ represents a hydrogen atom or methyl group, $R^{12}$ represents an alkyl group having 1 to 4 carbon atoms, $R^{13}$ represents an alkyl group having 1 to 8 carbon atoms or an alkoxy group having 1 to 4 carbon atoms, n represents an integer of from 1 to 8, and Y represents a molar percent of from 10 to 90.

This cross-linked product suppresses the occurrence of resistance increase in the carrier, and thereby the carrier secures temporal resistance stability. In addition, this cross-linked product effectively suppresses adhesion of a spent toner to the carrier. Each of the above-described cross-linked products and resins may be used alone or combination with others. Form the aspect of curability, it is preferable that multiple types of resins are used in combination. When the above cross-lined product is used in combination with a silicone resin, charging ability of the carrier can be more properly adjusted.

In the condensation, titanium-based, tin-based, zirconium-based, and aluminum-based catalysts can be used. Among such catalysts, titanium-based catalysts have superior catalytic properties. Specifically, titanium diisopropoxy-bis(ethyl acetoacetate) is most preferable. Such catalysts are considered to effectively accelerate condensation of silanol groups while maintaining good catalytic ability.

Preferably, the content rate of the cross-lined product in the resin layer is from 3% to 65% by mass, more preferably, from 5% to 50% by mass.

Whether the resin layer includes the cross-lined product or not can be determined by any known method. For example, one possible method includes dissolving the resin layer with a solvent, removing the solvent to isolate the residue, and subjecting the residue to an IR measurement to analyze the dissolved resin.

Another preferred example of the resin in the resin layer includes a combination of a silicone resin and an acrylic resin. Acrylic resins have high adhesiveness and low brittleness, thereby exhibiting superior abrasion resistance. At the same time, acrylic resins have a high surface energy, which causes a spent toner to easily adhere thereto. When applied to a carrier, an acrylic resin may cause charge decrease in the carrier as a spent toner is accumulated on the carrier. This problem can be solved by using a silicone resin in combination with the acrylic resin. In contrast to acrylic resins, silicone resins have a low surface energy, which suppresses a spent toner from adhering thereto. In addition, when included in the resin layer, silicone resins allow the resin layer to be abraded, thus preventing a spent toner from accumulating on the carrier. At the same time, silicone resins have a drawback of poor abrasion resistance because of their low adhesiveness and high brittleness. When combining an acrylic resin and a silicone resin each having opposing properties, it is possible to obtain a resin layer that exhibits superior resistance to spent toner and abrasion.

Preferably, the content rates of the silicone resin and the acrylic resin in the resin layer are from 10% to 80% by mass and from 5% to 30% by mass, respectively.

In the present disclosure, silicone resins refer to all known silicone resins, such as straight silicone resins consisting of organosiloxane bonds, and modified silicone resins (e.g., alkyd-modified, polyester-modified, epoxy-modified, acrylic-modified, and urethane-modified silicone resins). Specific examples of the silicone resins include, but are not limited to, commercially-available products such as KR271, KR255, and KR152 (available from Shin-Etsu Chemical Co., Ltd.); and SR2400, SR2406, and SR2410 (available from Dow Corning Toray Co., Ltd.). The resin in the resin layer may include either a silicone resin alone or a combination of a silicone resin with other materials such as a cross-linkable component and a charge adjuster. Specific examples of the modified silicone resins include, but are not limited to, commercially-available products such as KR206 (alkyd-modified), KR5208 (acrylic-modified), ES1001N (epoxy-modified), and KR305 (urethane-modified) available from Shin-Etsu Chemical Co., Ltd.; and SR2115 (epoxy-modified) and SR2110 (alkyd-modified) available from Dow Corning Toray Co., Ltd.

In the present disclosure, acrylic resins refer to all known resins containing an acrylic component. The resin in the resin layer may include either an acrylic resin alone or a combination of an acrylic resin with at least one cross-linkable component. Specific examples of the cross-linkable component include, but are not limited to, an amino resin and an acidic catalyst. Examples of the amino resin include, but are not limited to, guanamine resins and melamine resins. Examples of the acidic catalyst include, but are not limited to, catalysts having a reactive group of a completely alkylated type, a methylol group type, an imino group type, or a methylol/imino group type.

Another preferred example of the resin in the resin layer includes a cross-lined product of an acrylic resin with an amino resin. In this case, the resin layers are prevented from fusing with each other, while remaining proper elasticity.

Examples of the amino resin include, but are not limited to, melamine resins and benzoguanamine resins, which can improve charge giving ability of the resulting carrier. To more properly control charge giving ability of the resulting carrier, a melamine resin and/or a benzoguanamine resin are/is preferably used in combination with another amino resin.

Examples of the acrylic resin that is cross-linkable with the amino resin include those having a hydroxyl group and/or a carboxyl group. Those having a hydroxy group are more preferred. Such a cross-linked product can improve adhesiveness between the resin layer and both the core particle and the conductive particle. In addition, the cross-linked product can improve dispersion stability of the conductive particle in the resin layer. Preferably, the acrylic resin has a hydroxyl value of 10 mgKOH/g or more, more preferably 20 mgKOH/g or more.

According to some embodiments of the present invention, tungsten tin oxide (hereinafter "WTO") is used as the conductive particle.

WTO is a tin-based material in which a certain amount of tungsten is doped. WTO has superior conductivity than the single element of tin. The inventors of the present invention have found that WTO can effectively reduce the resistance of the resin layer. WTO can reduce the resistance of the resin layer with a smaller amount compared to phosphorus tin oxide (hereinafter "PTO"). In addition, WTO can advantageously adjust the resistance of the carrier without causing a color contamination problem, which may be caused by carbon black, owing to whiteness thereof.

As described above, a related-art conductive particle having a core-shell structure has a drawback that the resistance may become unstable as the conductive coating film is abraded with time. There has been an attempt to more thickening the conductive coating film of the core-shell-type conductive particle to delay an exposure of the base particle. However, this attempt does not prevent an abrasion of the conductive coating film. In contrast to such a related-art conductive particle having a core-shell structure, the conductive particle according to an embodiment of the invention consisting of WTO reliably provides temporal resistance stability of the carrier, because WTO never disappears even when the carrier is abraded with time.

Preferably, WTO has an average particle diameter of from 10 to 300 nm, more preferably from 25 to 60 nm. Here, the average particle diameter refers to a volume average particle diameter.

When the average particle diameter of WTO is 300 nm or less, the amount of WTO exposed at the surface of the carrier is not so increased even when the resin layer of the carrier is abraded with time, thus preventing the occurrence of carrier scattering that may be caused by a resistance decrease. When the average particle diameter of WTO is 100 nm or more, WTO is suppressed from releasing from the resin layer together with the resin, even when the resin layer of the carrier is abraded with time, thus preventing the occurrence of carrier scattering that may be caused by a resistance decrease. WTO is advantageous in terms of temporal resistance stability and case in controlling particle diameter in the production process. The related-art conductive particle having a core-shell structure has a relatively large particle diameter because of containing the base particle. On the other hand, it is difficult to produce a small-diameter conductive particle having a core-shell structure. In the relate-art conductive particle having a core-shell structure, the base particle is given a certain degree of chargeability and a relatively large diameter, so that base particle is properly exposed at the surface of the carrier for effectively charging toner. A larger exposure area is more advantageous for the base particle in triboelectrically charging toner.

Such a related-art conductive particle cannot reliably provide temporal charge stability. By contrast, the conductive particle according to some embodiments of the present invention, including WTO, provides superior carrier properties.

Preferably, the content rate of the conductive particle in the resin layer is from 15% to 80% by mass, more preferably, from 45% to 65% by mass. The conductive particle may include materials other than WTO. In this case, preferably, the content rate of the materials other than WTO in the conductive particle is 75% by mass or less.

Specific examples of the chargeable filler include, but are not limited to, barium sulfate, hydrotalcite, and aluminum oxide. Among these materials, barium sulfate is most preferable.

In accordance with some embodiments of the present invention, the combination of the conductive particle and the chargeable filler reliably provides temporal charge stability. In the related-art conductive particle having a core-shell structure, as described above, the base particle is given a certain degree of chargeability and exhibits chargeability when exposed at the surface of the carrier. To make the base particle exhibit chargeability, the conductive coating film needs to be abraded while deteriorating conductivity of the conductive particle. Thus, the related-art conductive particle cannot exhibit conductivity and chargeability at the same time. By contrast, the conductive particle according to some embodiments of the present invention uses the conductive particle and the chargeable filler in combination. This configuration makes the carrier reliably exhibit temporal conductivity and chargeability at the same time, since the chargeable filler secures charging ability even when the conductive coating film is not abraded and the conductive particle secures conductivity even when the conductive coating film is abraded. Thus, the carrier according to some embodiments of the present invention can contribute to a longer lifespan.

To secure temporal charging stability of the carrier, preferably, the chargeable filler is present at the surface of the carrier. Thus, preferably, the chargeable filler has an average particle diameter of from 400 to 900 nm, more preferably from 450 to 600 nm. When the average particle diameter of the chargeable filler is 900 nm or less, the chargeable filler will not be excessively exposed at the surface of the carrier even when the resin layer is abraded with time, thus preventing the occurrence of carrier scattering that may be caused when the chargeability is excessively high. When the average particle diameter of the chargeable filler is 400 nm or more, the chargeable filler will be properly exposed at the surface of the carrier as the resin layer is abraded with time, thus compensating a decrease in chargeability and preventing the occurrence of toner scattering. The combination of the conductive particle and the chargeable filler, preferably having an average particle diameter within the above-described range, provides a long-life high-quality carrier.

The combination use of the conductive particle and the chargeable filler causes a secondary effect that the abrasion resistance of the resin layer of the carrier is improved. A greater amount of the filler causes the filler to occupy a larger surface of the carrier. At the same time, the resin layer is not so much exposed at the surface of the carrier. Thus, the resin layer is not so much abraded, thus contributing to extension of the life of the carrier.

Preferably, the content rate of the chargeable filler in the resin layer is from 35% to 65% by mass, more preferably, from 40% to 55% by mass.

Whether or not the conductive particle and the chargeable filler are included in the resin layer can be determined by any known method. The average particle diameters of the conductive particle and the chargeable filler can also be determined by any known method. In one example method, a carrier is cut with an FIB (Focused Ion Beam) and the cross-section is observed with a SEM (Scanning Electron Microscope).

More specifically, a sample (carrier) is adhered onto a piece of carbon tape and gets an osmium coating having thickness of about 20 nm that protects the surface of the sample and gives conductivity thereto. The sample is thereafter subjected to an FIB treatment using an instrument NVision 40 (product of Carl Zeiss (SII)) under the following conditions.

Accelerating Voltage: 2.0 kV
Aperture: 30 μm
High Current: ON
Detector: SE2
In Lens
Conductive Treatment: None
W.D.: 5.0 mm
Sample Tilt Angle: 54°

The sample is then subjected to a SEM observation and an element mapping using an electron cooling SDD detector ULTRA DRY (having a diameter of 30 $mm^2$) and an analysis software program NORAN System 6 (NSS), both products of Thermo Fischer Scientific Inc., under the following conditions.

Accelerating Voltage: 3.0 kV
Aperture: 120 μm
High Current: ON
Conductive Treatment: Os
Drift Correction: Yes
W.D.: 10.0 mm
Measurement Method: Area Scan
Accumulation Time: 10 see
Accumulation Number: 100 times
Sample Tilt Angle: 54°

The resin layer may include a silane coupling agent for dispersing the conductive particle more reliably.

Specific examples of usable silane coupling agents include, but are not limited to, γ-(2-aminoethyl)aminopropyl trimethoxysilane, γ-(2-aminoethyl)aminopropylmethyl dimethoxysilane, γ-methacryloxypmpyl trimethoxysilane, N-β-(N-vinylbenzylaminoethyl)-γ-aminopropyl trimethoxysilane hydrochloride, 7-glycidoxypropyl trimethoxysilane, γ-mercaptopropyl trimethoxysilane, methyl trimethoxysilane, methyl triethoxysilane, vinyl triacetoxysilane, γ-chloropropyl trimethoxysilane, hexamethyl disilazane, 7-anilinopropyl trimethoxysilane, vinyl trimethoxysilane, octadecyldimethyl[3-(trimethoxysilyl)propyl]ammonium chloride, γ-chloropropylmethyl dimethoxysilane, methyl trichlorosilane, dimethyl dichlorosilane, trimethyl chlorosilane, allyl triethoxysilane, 3-aminopropylmethyl diethoxysilane, 3-aminopropyl trimethoxysilane, dimethyl diethoxysilane, 1,3-divinyltetramethyl disilazane, and methacryloxyethyldimethyl(3-trimethoxysilylpropyl) ammonium chloride. Two or more of these materials can be used in combination.

Specific examples of commercially available silane coupling agents include, but are not limited to, AY43-059, SR6020, SZ6023, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, and Z-6940 (available from Dow Corning Toray Co., Ltd.).

Preferably, the silane coupling agent is used in combination with a silicone resin. In this case, preferably, the ratio of the silane coupling agent to the silicone resin is from 0.1% to 10% by mass. When the ratio of the silane coupling agent is less than 0.1% by mass, adhesion strength between the core particle/conductive particle and the silicone resin may be poor. When the ratio of the silane coupling agent is in excess of 10% by mass, toner filming may occur in a long-term use.

A two-component developer according to an embodiment of the present invention includes the above-described carrier and a toner.

The toner includes a binder resin. The toner may be either a monochrome toner, color toner, white toner, or transparent toner. When WTO is used as the conductive particle in the carrier, a color contamination problem, which may be caused when the carrier contains carbon black, is avoided even when the carrier is combined with a color toner (especially yellow toner), white toner, or transparent toner. The toner may further include a release agent, to be used for oilless fixing systems that include a fixing roller having no oil application. Although such a toner including a release agent is likely to cause a filming problem, the carrier according to an embodiment can prevent the filming problem. Therefore, the two-component developer according to an embodiment of the present invention can provide high-quality images for an extended period of time.

Preferably, the contents of the carrier and the toner are from 88 to 98 parts by mass and from 2 to 12 parts by mass, respectively, in 100 parts by mass of the two-component developer.

The toner can be produced by known methods such as pulverization methods and polymerization methods. In a typical pulverization method, raw materials of a toner are melt-kneaded, the melt-kneaded mixture is cooled and pulverized into particles, and the particles are classified by size, thus preparing mother particles. The mother particles then get coated with an external additive to more improve transferability and durability, thus obtaining a toner.

Specific examples of usable kneaders include, but are not limited to, a batch-type double roll mill; Banbury mixer; double-axis continuous extruders such as TWIN SCREW EXTRUDER KTK (from Kobe Steel, Ltd.), TWIN SCREW COMPOUNDER TEM (from Toshiba Machine Co., Ltd.), MIRACLE K.C.K (from Asada Iron Works Co., Ltd.), TWIN SCREW EXTRUDER PCM (from Ikegai Co., Ltd.), and KEX EXTRUDER (from Kurimoto, Ltd.); and single-axis continuous extruders such as KONEADER (from Buss Corporation).

When being pulverized, the melt-kneaded mixture may be firstly pulverized into coarse particles by a hammer mill or a roatplex, and then the coarse particles may be pulverized into fine particles by a jet-type pulverizer or a mechanical pulverizer. In this case, preferably, the fine particles have an average particle diameter of from 3 to 15 μm.

In classifying the fine particles, a wind-power classifier may be used. In this case, preferably, the fine particles may be classified such that the resulting mother particles have an average particle diameter of from 5 to 20 μm.

The mother particles get coated with the external additive by being mixed with the external additive using a mixer. The external additive gets adhered to the surfaces of the mother particles while being pulverized in the mixer.

Specific examples of usable binder resins include, but are not limited to, homopolymers of styrene or styrene derivatives (e.g., polystyrene, poly-p-styrene, polyvinyl toluene), styrene-based copolymers (e.g., styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleate copolymer), polymethyl methacrylate, polybutyl methacrylate, polyvinyl chloride, polyvinyl acetate, polyethylene, polyester, polyurethane, epoxy resin, polyvinyl butyral, polyacrylic acid, rosin, modified rosin, terpene resin, phenol resin, aliphatic or aromatic hydrocarbon resin, and aromatic petroleum resin. Two or more of these resins can be used in combination.

Additionally, the following binder resins used for pressure fixing can also be used: polyolefins (e.g., low-molecular-weight polyethylene, low-molecular-weight polypropylene), olefin copolymers (e.g., ethylene-acrylic acid copolymer, ethylene-acrylate copolymer, styrene-methacrylic acid copolymer, ethylene-methaorylate copolymer, ethylene-vinyl chloride copolymer, ethylene-vinyl acetate copolymer, ionomer resin), epoxy resin, polyester resin, styrene-butadiene copolymer, polyvinyl pyrrolidone, methyl vinyl ether-maleic acid anhydride copolymer, maleic-acid-modified phenol resin, and phenol-modified terpene resin. Two or more of these resins can be used in combination.

Specific examples of usable colorants (e.g., pigments, dyes) include, but are not limited to, yellow colorants such as Cadmium Yellow, Mineral Fast Yellow, Nickel Titan Yellow, Naples Yellow, Naphthol Yellow S, Hansa Yellow G, Hansa Yellow 10G, Benzidine Yellow GR, Quinoline Yellow Lake, Permanent Yellow NCG, and Tartrazine Lake; orange colorants such as Molybdenum Orange, Permanent Orange GTR, Pyrazolone Orange, Vulcan Orange, Indanthrene Brilliant Orange RK, Benzidine Orange G, and Indanthrene Brilliant Orange GK; red colorants such as Colcothar, Cadmium Red, Permanent Red 4R, Lithol Red, Pyrazolone Red, Watching Red Calcium Salt, Lake Red D, Brilliant Carmine 6B, Eosin Lake, Rhodamine Lake B, Alizarine Lake, and Brilliant Carmine 3B; violet colorants such as Fast Violet B and Methyl Violet Lake; blue colorants such as Cobalt Blue, Alkali Blue, Victoria Blue Lake, Phthalocyanine Blue, Metal-free Phthalocyanine Blue, Phthalocyanine Blue Partial Chloride, Fast Sky Blue, and Indanthrene Blue BC; green colorants such as Chrome Green, Chrome Oxide, Pigment Green B, and Malachite Green Lake; black colorants such as azine dyes (e.g., Carbon Black, Oil Furnace Black, Channel Black, Lamp Black, Acetylene Black, Aniline Black), metal salt azo dyes, metal oxides, and complex metal oxides; and white colorants such as titanium oxide. Two or more of these colorants can be used in combination. In the case of a transparent toner, a colorant is needless.

Specific examples of usable release agents include, but are not limited to, polyolefins (e.g., polyethylene, polypropylene), fatty acid metal salts, fatty acid esters, paraffin waxes, amide waxes, polyvalent alcohol waxes, silicone varnishes, carnauba waxes, and ester waxes. Two or more of these materials can be used in combination.

The toner may further include a charge controlling agent. Specific examples of usable charge controlling agents include, but are not limited to, nigrosine dyes, azine dyes having an alkyl group having 2 to 16 carbon atoms; basic dyes (e.g., C. I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040), C. I. Basic Green 4 (C. I. 42000)) and lake pigments thereof; quaternary ammonium salts (e.g., C. I. Solvent Black 8 (C. I. 26150), benzoylmethylhexadecyl ammonium chloride, decyltrimethyl chloride); dialkyl (e.g., dibutyl, dioctyl) tin compounds; dialkyl tin borate compounds; guanidine derivatives; polyamine resins (e.g., vinyl polymers having amino group, condensed polymers having amino group); metal complex salts of monoazo dyes; metal complexes of salicylic acid, dialkyl salicylic acid, naphthoic acid, and dicarboxylic acid with Zn, Al, Co, Cr, and Fe; sulfonated copper phthalocyanine pigments; organic boron salts; fluorine-containing quaternary ammonium salts; and calixarene compounds. Two or more of these materials can be used in combination. In the case of a toner other than black toner, a metal salt of a salicylic acid derivative that is white is preferable.

Specific examples of usable external additives include, but are not limited to, inorganic particles such as silica, titanium oxide, alumina, silicon carbide, silicon nitride, and boron nitride; and resin particles such as polymethyl methacrylate particles and polystyrene particles, having an average particle diameter of 0.05 to 1 μm, obtainable by soap-free emulsion polymerization. Two or more of these materials can be used in combination. In particular, hydrophobized metal oxide particles (e.g., silica, titanium oxide) are preferable. When a hydrophobized silica and a hydrophobized titanium oxide are used in combination with the amount of the hydrophobized titanium oxide greater than that of the hydrophobized silica, the toner provides excellent charge stability regardless of humidity.

The two-component developer according to an embodiment of the present invention may be used as a supplemental developer. Preferably, the supplemental developer is supplied to a type of image forming apparatus in which surplus developer is discharged from the developing device while forming images. Such a type of image forming apparatus can produce high-quality images for an extremely extended period of time, as the supplemental developer is supplied. This is because, as the supplemental developer is supplied, deteriorated carrier particles stored in the developing device are replaced with fresh carrier particles included in the supplemental developer, and thus the developer in the developing device can maintain a constant amount of charge for an extended period of time. Such a type of image forming apparatus is advantageous for printing images with a high image area occupancy. When printing an image having a high image area occupancy, generally, carrier particles get deteriorated as spent toner particles get adhered thereto. In the above type of image forming apparatus, since a large amount of supplemental carrier particles are supplied when printing an image having a high image area occupancy, deteriorated carrier particles can be more frequently replaced with fresh carrier particles, thus continuously producing high-quality images for an extended period of time. Preferably, the supplemental developer includes 2 to 50 parts by mass of the toner based on 1 part by mass of the carrier. When the content of the toner is less than 2 parts by mass, the amount of carrier particles in the supplemental developer is too large, thus making the carrier concentration in the developing device too high and the amount of charge of the developer excessively increased. As the amount of charge of the developer is increased, the developing ability of the developer is deteriorated and the resulting image density is lowered. When the content of the toner is in excess of 50 parts by mass, the amount of carrier particles in the supplemental developer is too small. Thus, deteriorated carrier particles in the developing device are less frequently replaced with fresh carrier particles.

The two-component developer according to an embodiment of the present invention can be used as either a supplemental developer, as described above, or a developer stored in a trickle developing device. In either case, the surface of the carrier is prevented from being abraded, and the spent toner is prevented from adhering to the surface of the carrier. Thus, either the amount of charge of the developer in the developing device or the electric resistance of the carrier is prevented from lowering, and the carrier reliably provides constant developing property.

An image forming apparatus according to an embodiment of the present invention includes: an electrostatic latent image bearer, a charger to charge the electrostatic latent image bearer; an irradiator to irradiate the charged electrostatic latent image bearer with light to form an electrostatic latent image thereon; a developing device to develop the electrostatic latent image formed on the electrostatic latent image bearer with the developer according to an embodiment of the present invention, to form a toner image; a transfer device to transfer the toner image from the electrostatic latent image bearer onto a recording medium; and a fixing device to fix the toner image on the recording medium. The image forming apparatus may further include other devices such as a neutralizer, a cleaner, a recycler, and a controller.

An image forming method according to an embodiment of the present invention includes the following processes: forming an electrostatic latent image on an electrostatic latent image bearer; developing the electrostatic latent image formed on the electrostatic latent image bearer with the developer according to an embodiment of the present invention, to form a toner image; transferring the toner image from the electrostatic latent image bearer onto a recording medium; and fixing the toner image on the recording medium. The image forming method may further include other processes such as neutralizing, cleaning, recycling, and controlling processes.

A schematic view of a process cartridge according to an embodiment of the present invention is illustrated in the accompanying drawing. This process cartridge includes a photoconductor 20 serving as an electrostatic latent image bearer, a charger 32 for charging the photoconductor 20, a developing device 40, and a cleaner 61. The charger 32 may be a proximity charger in the form of a brush. The developing device 40 develops an electrostatic latent image formed on the photoconductor 20 into a toner image, with the developer according to an embodiment of the present invention. The cleaner 61 removes residual toner particles remaining on the photoconductor 20 after the toner image has been transferred from the photoconductor 20 onto a recording medium. The process cartridge is detachably mountable on image forming apparatuses such as copiers and printers.

An image forming apparatus on which this process cartridge is mounted forms images in the following manner. First, the photoconductor 20 is driven to rotate at a certain peripheral speed. The peripheral surface of the photoconductor 20 is uniformly charged to a certain positive or negative potential by the charger 32. The charged peripheral surface of the photoconductor 20 is irradiated with light emitted from an irradiator (e.g., slit irradiator, scanning irradiator). Thus, an electrostatic latent image is formed on the photoconductor 20. The electrostatic latent image formed on the peripheral surface of the photoconductor 20 is developed into a toner image with the developer according to an embodiment of the present invention by the developing device 40. The toner image formed on the peripheral surface of the photoconductor 20 is transferred onto a transfer paper sheet (serving as a recording medium) that is fed to between the photoconductor 20 and a transfer device from a sheet feeder in synchronization with rotation of the photoconductor 20. The transfer paper sheet having the toner image thereon is separated from the peripheral surface of the photoconductor 20 and introduced into a fixing device. In the fixing device, the toner image is fixed on the transfer paper sheet, becoming a copy. The copy is discharged from the image forming apparatus. The cleaner 61 removes residual toner particles remaining on the peripheral surface of the photoconductor 20 after the toner image has been transferred from the photoconductor 20. The photoconductor 20 having cleaned is neutralized by a neutralizer to be ready for a next image forming operation.

EXAMPLES

Having generally described this invention, further understanding can be obtained by reference to certain specific examples which are provided herein for the purpose of illustration only and are not intended to be limiting. In the descriptions in the following examples, the numbers represent mass ratios in parts, unless otherwise specified.

Preparation of Toner

Binder Resin Preparation Example 1

In a reaction vessel equipped with a condenser, a stirrer, and a nitrogen introducing tube, 724 parts of ethylene oxide 2 mol adduct of bisphenol A, 276 parts of isophthalic acid, and 2 parts of dibutyltin oxide were contained, and subjected to a reaction for 8 hours at 230° C. under normal pressures, and subsequently 5 hours under reduced pressures of from 10 to 15 mmHg. After being cooled to 160° C., the vessel was further charged with 32 parts of isophthalic anhydride, and the vessel contents were subjected to a reaction for 2 hours.

After being cooled to 80° C., the vessel contents were further reacted with 188 parts of isophorone diisocyanate in ethyl acetate for 2 hours. Thus, an isocyanate-containing prepolymer (P1) was obtained.

Next, 267 parts of the prepolymer (P1) was reacted with 14 parts of isophoronediamine for 2 hours at 50° C. Thus, an urea-modified polyester (UI) having a weight average molecular weight of 64,000 was obtained.

In the same manner as described above, 724 parts of ethylene oxide 2 mol adduct of bisphenol A and 276 parts of terephthalic acid were subjected to a polycondensation for 8 hours at 230° C. under normal pressures, and subsequently 5 hours under reduced pressures of from 10 to 15 mmHg.

Thus, an unmodified polyester (E1) having a peak molecular weight of 5000 was obtained.

Next, 200 parts of the urea-modified polyester (UI) and 800 parts of the unmodified polyester (E1) were dissolved in 2,000 parts of an ethyl acetate/MEK mixed solvent (in which 1 part of ethyl acetate and 1 part of MEK (methyl ethyl ketone) were mixed) to obtain an ethyl acetate/MEK solution of a binder resin (B1).

A part of the solution was dried under reduced pressures to isolate the binder resin (B1).

Polyester Resin Preparation Example 1

Terephthalic acid: 60 parts

Dodecenyl succinic anhydride: 25 parts

Trimellitic anhydride: 15 parts

Bisphenol A (2,2) propylene oxide: 70 parts

Bisphenol A (2,2) ethylene oxide: 50 parts

The above compositions were contained in a l-liter four-necked round-bottom flask equipped with a thermometer, a stirrer, a condenser, and a nitrogen gas introducing tube. The flask was set in a mantle heater to get heated, and charged with nitrogen gas through the nitrogen gas introducing tube so that an inert atmosphere was created therein. While the flask was kept at 200° C., 0.05 g of dibutyltin oxide was added to the flask, and the flask contents were subjected to a reaction. Thus, a polyester resin 1 was obtained.

Master Batch Preparation Example 1

Pigment: C.I. Pigment Yellow 155:40 parts

Binder resin: Polyester resin 1: 60 parts

Water: 30 parts

The above materials were mixed using a HENSCHEL MIXER, thus obtaining a pigment aggregation into which water has permeated. The pigment aggregation was kneaded for 45 minutes using a double roll while setting the surface temperature to 130° C., and then pulverized into particles having a diameter of about 1 mm using a pulverizer. Thus, a master batch (MI) was obtained.

Toner Preparation Example 1

In a beaker, 240 parts of the ethyl acetate/MEK solution of the binder resin (B1), 20 parts of pentaerythritol tetrabehenate (having a melting point of 81° C. and a melt viscosity of cps), and 8 parts of the master batch (MI) were contained, and uniformly stirred using a TK HOMOMIXER at 12,000 rpm and 60° C. Thus, a toner material liquid was prepared.

In another beaker, 706 parts of ion-exchange water, 294 parts of a 10% hydroxyapatite suspension liquid (SUPA-TAITO 10, product of Nippon Chemical Industrial Co., Ltd.), and 0.2 parts of sodium dodecylbenzenesulfonate were contained and heated to 60° C. While the beaker contents were uniformly stirred using a TK HOMOMIXER at 12,000 rpm, the above-prepared toner material liquid was mixed therein, and the beaker contents were further stirred for 10 minutes.

The resulting mixture was transferred to a flask equipped with a stirrer and a thermometer, heated to 98° C. so that the solvent was removed, and successively subjected to the processes of filtration, washing, drying, and wind-power classification. Thus, a mother toner particle 1 was obtained.

Next, 100 parts of the mother toner particle 1 was mixed with 1.0 part of a hydrophobic silica and 1.0 part of a hydrophobized titanium oxide using a HENSCHEL MIXER. Thus, a toner 1 was obtained.

The toner 1 had a volume average particle diameter (Dv) of 6.2 μm and a number average particle diameter (Dn) of 5.1 μm, when measured by a particle size analyzer COULTER COUNTER TA-II (available from Beckman Coulter, Inc.) with an aperture diameter of 100 μm.

The toner 1 had an average circularity of 0.96, when measured by a flow particle image analyzer FPIA-1000 (available from Sysmex Corporation). In the measurement of average circularity, 0.1 to 0.5 g of the toner was dispersed in 100 to 150 ml of water from which solid impurities had been removed and 0.1 to 0.5 ml of a surfactant (an alkylbenzene sulfonate) had been added, using an ultrasonic disperser, for about 1 to 3 minutes. The toner concentration in the resulting dispersion was adjusted to 3,000 to 10,000 particles per micro-liter.

Preparation of Copolymer

In a flask equipped with a stirrer, 300 g of toluene was contained and heated to 90° C. under a nitrogen gas flow.

Next, a mixture of 84.4 g (i.e., 200 mmol) of 3-methacryloxypropyl tris(trimethylsiloxy)silane (SILAPLANE TM-0701T available from Chisso Corporation) represented by the chemical formula $CH_2{=}CMe\text{-}COO{-}C_3H_6{-}Si(OSiMe_3)_3$, where Me represents methyl group, 39 g (i.e., 150 mmol) of 3-methacryloxypropylmethyl diethoxysilane, 65.0 g (i.e., 650 mmol) of methyl methacrylate, and 0.58 g (i.e., 3 mmol) of 2,2'-azobis-2-methylbutylonitrile was dropped in the flask over a period of 1 hour.

Further, a solution of 0.06 g (i.e., 0.3 mmol) of 2,2'-azobis-2-methylbutylonitrole dissolved in 15 g of toluene was added to the flask. (The total amount of 2,2'-azobis-2-methylbutylonitrole was 0.64 g, i.e., 3.3 mmol.) The flask contents were then agitated for 3 hours at from 90 to 100° C. to be subjected to a radical copolymerization. Thus, a methacrylic copolymer 1 was obtained.

The methacrylic copolymer 1 had a weight average molecular weight of 33,000.

The methacrylic copolymer was diluted with toluene such that the resulting copolymer solution contained 25% by mass of nonvolatile contents.

The resulting copolymer solution had a viscosity of 8.8 $mm^2/s$ and a specific weight of 0.91.

The weight average molecular weight of the copolymer was determined by gel permeation chromatography using polystyrene standard samples. The viscosity of the copolymer solution was measured at 25° C. based on a method according to JIS-K2283. The content rate of nonvolatile contents was determined by heating 1 g of the solution in an aluminum pan at 150° C. for 1 hour and measuring the difference in mass of the solution before and after the heating. In particular, the content rate was determined from the following equation, wherein Ma and Mb respectively represent the masses of the solution after and before the heating.

$$\text{Nonvolatile content (\%)}=(Mb-Ma)\times 100/Mb$$

Preparation of Carriers

Carrier Preparation Example 1

Composition of Resin Solution 1

Acrylic resin solution (having a solid content concentration of 20% by mass): 200 parts Silicone resin solution (having a solid content concentration of 40% by mass): 2,000 parts Aminosilane (having a solid content concentration of 100% by mass): 10 parts Tungsten tin oxide (having an average particle diameter of 100 nm): 600 parts Barium sulfate (having an average particle diameter of 600 nm): 1,000 parts Toluene: 6,000 parts The above materials were subjected to a dispersion treatment using a homomixer for 10 minutes, thus obtaining a resin solution 1. The resin solution 1 was coated on a core material made of a Mn—Mg—Sr ferrite having a particle diameter of 35 μm, using a SPIRA COTA (from Okada Seiko Co., Ltd.) at a rate of 25 g/min in an atmosphere having a temperature of 80° C., followed by drying. The resulting coating layer had a thickness of 0.37 μm. The thickness of the coating layer was adjusted by adjusting the amount of the resin solution. The core material having the coating layer was burnt in an electric furnace at 230° C. for 1 hour, then cooled, and pulverized through a 100-μm sieve. Thus, a carrier 1 was obtained. The volume average particle diameter of the core material was measured using a Microtrac particle size analyzer SRA (from Nikkiso Co., Ltd.) while setting the measuring range to between 0.71 and 125 μm.

The silicone resin solution and aminosilane used in this Example and the following Examples were commercial products SR2410 and SH6020, respectively, available from Dow Corning Toray Co., Ltd.

Carrier Preparation Example 2

Composition of Resin Solution 2

Acrylic resin solution (having a solid content concentration of 20% by mass): 200 parts Silicone resin solution (having a solid content concentration of 40% by mass): 2,000 parts Aminosilane (having a solid content concentration of 100% by mass): 10 parts Tungsten tin oxide (having an average particle diameter of 8 nm): 600 parts Barium sulfate (having an average particle diameter of 600 nm): 1,000 parts Toluene: 6,000 parts The procedure in Carrier Preparation Example 1 was repeated except for replacing the resin solution 1 with the resin solution 2 having the above composition. Thus, a carrier 2 was obtained.

Carrier Preparation Example 3

Composition of Resin Solution 3

Acrylic resin solution (having a solid content concentration of 20% by mass): 200 parts Silicone resin solution (having a solid content concentration of 40% by mass): 2,000 parts Aminosilane (having a solid content concentration of 100% by mass): 10 parts Tungsten tin oxide (having an average particle diameter of 10 nm): 600 parts Barium sulfate (having an average particle diameter of 600 nm): 1,000 parts Toluene: 6,000 parts The procedure in Carrier Preparation Example 1 was repeated except for replacing the resin solution 1 with the resin solution 3 having the above composition. Thus, a carrier 3 was obtained.

Carrier Preparation Example 4

Composition of Resin Solution 4

Acrylic resin solution (having a solid content concentration of 20% by mass): 200 parts Silicone resin solution (having a solid content concentration of 40% by mass): 2,000 parts Aminosilane (having a solid content concentration of 100% by mass): 10 parts Tungsten tin oxide (having an average particle diameter of 300 nm): 600 parts Barium sulfate (having an average particle diameter of 600 nm): 1,000 parts Toluene: 6,000 parts The procedure in Carrier Preparation Example 1 was repeated except for replacing the resin solution 1 with the resin solution 4 having the above composition. Thus, a carrier 4 was obtained.

Carrier Preparation Example 5

Composition of Resin Solution 5

Acrylic resin solution (having a solid content concentration of 20% by mass): 200 parts Silicone resin solution (having a solid content concentration of 40% by mass): 2,000 parts Aminosilane (having a solid content concentration of 100% by mass): 10 parts Tungsten tin oxide (having an average particle diameter of 310 nm): 600 parts Barium sulfate (having an average particle diameter of 600 nm): 1,000 parts Toluene: 6,000 parts The procedure in Carrier Preparation Example 1 was repeated except for replacing the resin solution 1 with the resin solution 5 having the above composition. Thus, a carrier 5 was obtained.

Carrier Preparation Example 6

Composition of Resin Solution 6

Acrylic resin solution (having a solid content concentration of 20% by mass): 200 parts Silicone resin solution (having a solid content concentration of 40% by mass): 2,000 parts Aminosilane (having a solid content concentration of 100% by mass): 10 parts Tungsten tin oxide (having an average particle diameter of 100 nm): 600 parts Barium sulfate (having an average particle diameter of 380 nm): 1,000 parts Toluene: 6,000 parts The procedure in Carrier Preparation Example 1 was repeated except for replacing the resin solution 1 with the resin solution 6 having the above composition. Thus, a carrier 6 was obtained.

Carrier Preparation Example 7

Composition of Resin Solution 7

Acrylic resin solution (having a solid content concentration of 20% by mass): 200 parts Silicone resin solution (having a solid content concentration of 40% by mass): 2,000 parts Aminosilane (having a solid content concentration of 100% by mass): 10 parts Tungsten tin oxide (having an average particle diameter of 100 nm): 600 parts Barium sulfate (having an average particle diameter of 400 nm): 1,000 parts Toluene: 6,000 parts The procedure in Carrier Preparation Example 1 was repeated except for replacing the resin solution 1 with the resin solution 7 having the above composition. Thus, a carrier 7 was obtained.

Carrier Preparation Example 8

Composition of Resin Solution 8

Acrylic resin solution (having a solid content concentration of 20% by mass): 200 parts Silicone resin solution (having a solid content concentration of 40% by mass): 2,000 parts Aminosilane (having a solid content concentration of 100% by mass): 10 parts Tungsten tin oxide (having an average particle diameter of 100 nm): 600 parts Barium sulfate (having an average particle diameter of 900 nm): 1,000 parts Toluene: 6,000 parts The procedure in Carrier Preparation Example 1 was repeated except for replacing the resin solution 1 with the resin solution 8 having the above composition. Thus, a carrier 8 was obtained.

Carrier Preparation Example 9

Composition of Resin Solution 9

Acrylic resin solution (having a solid content concentration of 20% by mass): 200 parts Silicone resin solution (having a solid content concentration of 40% by mass): 2,000 parts Aminosilane (having a solid content concentration of 100% by mass): 10 parts Tungsten tin oxide (having an average particle diameter of 100 nm): 600 parts Barium sulfate (having an average particle diameter of 910 nm): 1,000 parts Toluene: 6,000 parts The procedure in Carrier Preparation Example 1 was repeated except for replacing the resin solution 1 with the resin solution 9 having the above composition. Thus, a carrier 9 was obtained.

Carrier Preparation Example 10

Composition of Resin Solution 10

Acrylic resin solution (having a solid content concentration of 20% by mass): 200 parts Silicone resin solution (having a solid content concentration of 40% by mass): 1,900 parts Methacrylic copolymer 1 (having a solid content concentration of 25% by mass): 100 parts Aminosilane (having a solid content concentration of 100% by mass): 10 parts Tungsten tin oxide (having an average particle diameter of 100 nm): 600 parts Barium sulfate (having an average particle diameter of 600 nm): 1,000 parts Toluene: 6,000 parts The procedure in Carrier Preparation Example 1 was repeated except for replacing the resin solution 1 with the resin solution 10 having the above composition. Thus, a carrier 10 was obtained.

Carrier Preparation Example 11

Composition of Resin Solution 11

Acrylic resin solution (having a solid content concentration of 20% by mass): 200 parts Silicone resin solution (having a solid content concentration of 40% by mass): 2,000 parts Aminosilane (having a solid content concentration of 100% by mass): 10 parts Carbon black (Ketjen black): 80 parts Barium sulfate (having an average particle diameter of 600 nm): 1,000 parts Toluene: 6,000 parts The procedure in Carrier Preparation Example 1 was repeated except for replacing the resin solution 1 with the resin solution 11 having the above composition. Thus, a carrier 11 was obtained.

Carrier Preparation Example 12

Composition of Resin Solution 12

Acrylic resin solution (having a solid content concentration of 20% by mass): 200 parts Silicone resin solution (having a solid content concentration of 40% by mass): 2,000 parts Aminosilane (having a solid content concentration of 100% by mass): 10 parts Alumina surface-treated with Tungsten tin oxide (having an average particle diameter of 100 nm): 800 parts Barium sulfate (having an average particle diameter of 600 nm): 1,000 parts Toluene: 6,000 parts The procedure in Carrier Preparation Example 1 was repeated except for replacing the resin solution 1 with the resin solution 12 having the above composition. Thus, a carrier 12 was obtained.

Carrier Preparation Example 13

Composition of Resin Solution 13

Acrylic resin solution (having a solid content concentration of 20% by mass): 200 parts Silicone resin solution (having a solid content concentration of 40% by mass): 2,000 parts Aminosilane (having a solid content concentration of 100% by mass): 10 parts Tungsten tin oxide (having an average particle diameter of 100 nm): 600 parts Toluene: 6,000 parts The procedure in Carrier Preparation Example 1 was repeated except for replacing the resin solution 1 with the resin solution 13 having the above composition. Thus, a carrier 13 was obtained.

Carrier Preparation Example 14

Composition of Resin Solution 14

Acrylic resin solution (having a solid content concentration of 20% by mass): 200 parts Silicone resin solution (having a solid content concentration of 40% by mass): 2,000 parts Aminosilane (having a solid content concentration of 100% by mass): 10 parts Alumina surface-treated with tungsten tin oxide (having an average particle diameter of 100 nm): 800 parts Toluene: 6,000 parts The procedure in Carrier Preparation Example 1 was repeated except for replacing the resin solution 1 with the resin solution 14 having the above composition. Thus, a carrier 14 was obtained.

Carrier Preparation Example 15

Composition of Resin Solution 15

Acrylic resin solution (having a solid content concentration of 20% by mass): 200 parts Silicone resin solution (having a solid content concentration of 40% by mass): 2,000 parts Aminosilane (having a solid content concentration of 100% by mass): 10 parts Tungsten tin oxide (having an average particle diameter of 100 nm): 600 parts Hydrotalcite (having an average particle diameter of 580 nm): 1,000 parts Toluene: 6,000 parts The procedure in Carrier Preparation Example 1 was repeated except for replacing the resin solution 1 with the resin solution 15 having the above composition. Thus, a carrier 15 was obtained.

Carrier Preparation Example 16

Composition of Resin Solution 16

Acrylic resin solution (having a solid content concentration of 20% by mass): 200 parts Silicone resin solution (having a solid content concentration of 40% by mass): 2,000 parts Aminosilane (having a solid content concentration of 100% by mass): 10 parts Tungsten tin oxide (having an average particle diameter of 100 nm): 600 parts Aluminum oxide (having an average particle diameter of 620 nm): 1,000 parts Toluene: 6,000 parts The procedure in Carrier Preparation Example 1 was repeated except for replacing the resin solution 1 with the resin solution 16 having the above composition. Thus, a carrier 16 was obtained.

The compositions of the above-prepared carriers were described in Table 1.

TABLE 1

| | Conductive Particle | | Chargeable Filler | |
|---|---|---|---|---|
| | Type | Average Particle Diameter (nm) | Type | Average Particle Diameter (nm) |
| Carrier 1 | WTO | 100 | Barium sulfate | 600 |
| Carrier 2 | WTO | 8 | Barium sulfate | 600 |
| Carrier 3 | WTO | 10 | Barium sulfate | 600 |
| Carrier 4 | WTO | 300 | Barium sulfate | 600 |
| Carrier 5 | WTO | 310 | Barium sulfate | 600 |
| Carrier 6 | WTO | 100 | Barium sulfate | 380 |
| Carrier 7 | WTO | 100 | Barium sulfate | 400 |
| Carrier 8 | WTO | 100 | Barium sulfate | 900 |
| Carrier 9 | WTO | 100 | Barium sulfate | 910 |
| Carrier 10 | WTO | 100 | Barium sulfate | 600 |
| Carrier 11 | Carbon black | 10 | Barium sulfate | 600 |
| Carrier 12 | Alumina surface-treated with tungsten tin oxide | 100 | Barium sulfate | 600 |
| Carrier 13 | WTO | 100 | None | N/A |
| Carrier 14 | Alumina surface-treated with tungsten tin oxide | 100 | None | N/A |
| Carrier 15 | WTO | 100 | Hydrotalcite | 580 |
| Carrier 16 | WTO | 100 | Aluminum oxide | 620 |

Example 1

A developer 1 was prepared by mixing 7 parts of the toner 1 and 93 parts of the carrier 1 for 3 minutes using a mixer.

The developer 1 was set in a digital full-color printer (IMAGIO MPC 4500, product of Ricoh Co., Ltd.). The printer was caused to output a text chart (including texts have a size of about 2 mm×2 mm) having an image area ratio of 5% on 120,000 sheets, and the following evaluations were performed thereafter.

Evaluation of Color Contamination

The printer was caused to output a solid image 1 immediately after the developer was set in the printer, and the solid image 1 was subjected to a measurement of a value E defined by the following formula (1), using an instrument X-RITE 938 (available from Amtec Co., Ltd) while setting the standard illuminant to D50. In addition, the printer was caused to output a solid image 2 after outputting the text chart on 120,000 sheets, and the solid image 2 was subjected to a measurement of a value E in the same manner as above. The value B for the solid image 2 is hereinafter referred to as E'. The degree of color contamination was evaluated by the difference between E and E', i.e., ΔE=E'−E, based on the following criteria.

$$E=\sqrt{(L^2+a^{*2}+b^{*2})} \quad \text{Formula (1)}$$

A: ΔE≤7

C: 7<ΔB

Evaluation of Carrier Scattering

The printer was caused to output a solid image on an A3-size sheet after outputting the text chart on 120,000 sheets. The number of white voids on the solid image, generated by the occurrence of carrier scattering, was counted and evaluated based on the following criteria.

A+: 0

A: 1 to 2

B: 3 to 5

C: 6 or greater

Evaluation of Toner Scattering

The printer was caused to output a white image after outputting the text chart on 120,000 sheets. The white image was subjected to a measurement of image density (ID), using an instrument X-RITE 938 (available from Amtec Co., Ltd) while setting the standard illuminant to D50. The degree of background fouling, caused by the occurrence of toner scattering, was evaluated by the difference in ID (ΔID) between the white image and the blank sheet based on the following criteria.

A+: 0.02<ΔID≤0.04

A: 0.04<ΔID≤0.10

B: 0.10<ΔID≤0.20

C: 0.20<ΔID

Example 2

The procedure in Example 1 was repeated except for replacing the carrier 1 with the carrier 2.

Example 3

The procedure in Example 1 was repeated except for replacing the carrier 1 with the carrier 3.

Example 4

The procedure in Example 1 was repeated except for replacing the carrier 1 with the carrier 4.

Example 5

The procedure in Example 1 was repeated except for replacing the carrier 1 with the carrier 5.

Example 6

The procedure in Example 1 was repeated except for replacing the carrier 1 with the carrier 6.

Example 7

The procedure in Example 1 was repeated except for replacing the carrier 1 with the carrier 7.

Example 8

The procedure in Example 1 was repeated except for replacing the carrier 1 with the carrier 8.

Example 9

The procedure in Example 1 was repeated except for replacing the carrier 1 with the carrier 9.

Example 10

The procedure in Example 1 was repeated except for replacing the carrier 1 with the carrier 10.

Comparative Example 1

The procedure in Example 1 was repeated except for replacing the carrier 1 with the carrier 11.

Comparative Example 2

The procedure in Example 1 was repeated except for replacing the carrier 1 with the carrier 12.

Comparative Example 3

The procedure in Example 1 was repeated except for replacing the carrier 1 with the carrier 13.

Comparative Example 4

The procedure in Example 1 was repeated except for replacing the carrier 1 with the carrier 14.

Example 11

The procedure in Example 1 was repeated except for replacing the carrier 1 with the carrier 15.

Example 12

The procedure in Example 1 was repeated except for replacing the carrier 1 with the carrier 16.

The evaluation results are shown in Table 2.

TABLE 2

| | | Color Contamination | Carrier Scattering | Toner Scattering |
|---|---|---|---|---|
| Example 1 | Carrier 1 | A | A | A+ |
| Example 2 | Carrier 2 | A | B | A |
| Example 3 | Carrier 3 | A | A | A |
| Example 4 | Carrier 4 | A | A | A |
| Example 5 | Carrier 5 | A | B | A |
| Example 6 | Carrier 6 | A | A | B |
| Example 7 | Carrier 7 | A | A | A |
| Example 8 | Carrier 8 | A | A | A |
| Example 9 | Carrier 9 | A | B | A+ |
| Example 10 | Carrier 10 | A | A+ | A+ |
| Comparative Example 1 | Carrier 11 | C | A+ | A |
| Comparative Example 2 | Carrier 12 | A | C | A |
| Comparative Example 3 | Carrier 13 | A | A | C |
| Comparative Example 4 | Carrier 14 | A | C | C |
| Example 11 | Carrier 15 | A | A | B |
| Example 12 | Carrier 16 | A | A | B |

It is clear from the evaluation results that the carriers according to some embodiments of the present invention exhibit superior temporal stability and durability.

By contrast, Comparative Example 1 is evaluated to be poor in color contamination. This is because carbon black is used as the conductive particle.

Comparative Example 2 is evaluated to be poor in carrier scattering. This is because an alumina surface-treated with tungsten tin oxide is used as the conductive particle.

Comparative Example 3 is evaluated to be poor in toner scattering. This is because no chargeable filler is included.

Comparative Example 4 is evaluated to be poor in both carrier scattering and toner scattering. This is because an alumina surface-treated with tungsten tin oxide is used as the conductive particle and no chargeable filler is included.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A carrier, comprising:

a magnetic core particle; and a resin layer coating a surface of the magnetic core particle, the resin layer including:

a resin;

a conductive particle including tungsten tin oxide and not having a core-shell structure; and a chargeable filler.

2. The carrier of claim 1, wherein the conductive particle has an average particle diameter of from 10 nm to 300 nm.

3. The carrier of claim 1, wherein the chargeable filler has an average particle diameter of from 400 nm to 900 nm.

4. The carrier of claim 1, wherein the resin includes a cross-linked product obtained by hydrolyzing a copolymer including structural units of formulae (A) and (B) to generate silanol groups, and thereafter condensing:

Formula (A)

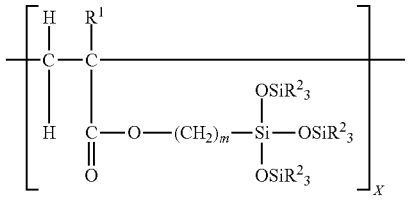

wherein $R^1$ represents a hydrogen atom or methyl group, $R^2$ represents an alkyl group having 1 to 4 carbon atoms, m represents an integer of from 1 to 8, and X represents a molar percent of from 10 to 90; and Formula (B)

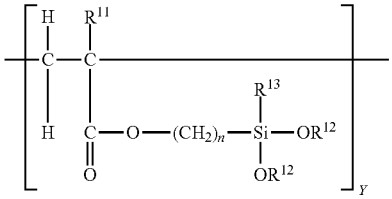

wherein $R^{11}$ represents a hydrogen atom or methyl group, $R^{12}$ represents an alkyl group having 1 to 4 carbon atoms, $R^{13}$ represents an alkyl group having 1 to 8 carbon atoms or an alkoxy group having 1 to 4 carbon atoms, n represents an integer of from 1 to 8, and Y represents a molar percent of from 10 to 90.

5. A two-component developer, comprising:

the carrier of claim 1; and a toner.

6. The two-component developer of claim 5, wherein the toner includes at least one of a colored toner, a white toner, and a transparent toner.

7. A supplemental developer, comprising:

the carrier of claim 1; and a toner.

8. An image forming apparatus, comprising:

an electrostatic latent image bearer;

a charger configured to charge the electrostatic latent image bearer;

an irradiator configured to irradiate the charged electrostatic latent image bearer with light to form an electrostatic latent image thereon;

a developing device configured to develop the electrostatic latent image formed on the electrostatic latent image bearer with the developer of claim 5 to form a toner image;

a transfer device configured to transfer the toner image from the electrostatic latent image bearer onto a recording medium; and a fixing device configured to fix the toner image on the recording medium.

9. A process cartridge, comprising:

an electrostatic latent image bearer;

a charger configured to charge the electrostatic latent image bearer;

a developing device configured to develop an electrostatic latent image formed on the electrostatic latent image bearer with the developer of claim 5 to form a toner image; and a cleaner configured to clean the electrostatic latent image bearer, wherein the process cartridge is detachably mountable on an image forming apparatus.

10. An image forming method, comprising:

forming an electrostatic latent image on an electrostatic latent image bearer;

developing the electrostatic latent image formed on the electrostatic latent image bearer with the developer of claim 5 to form a toner image;

transferring the toner image from the electrostatic latent image bearer onto a recording medium; and fixing the toner image on the recording medium.

11. The carrier of claim 1, wherein the conductive particle is a tin particle doped with tungsten.

12. The carrier of claim 1, wherein the conductive particle has an average particle diameter of from 25 nm to 60 nm.

13. The carrier of claim 1, wherein the magnetic core particle has a volume average particle diameter of 20 μm to 100 μm.

14. The carrier of claim 1, wherein the chargeable filler comprises at least one selected from the group consisting of barium sulfate, hydrotalcite, and aluminum oxide.

15. The carrier of claim 1, wherein the chargeable filler has an average particle diameter of from 450 nm to 600 nm.

16. The carrier of claim 1, wherein the conductive particle is included in the resin layer in an amount of from 15% to 80% by mass.

17. The carrier of claim 1, wherein the chargeable filler is included in the resin layer in an amount of from 35% to 65% by mass.

18. The carrier of claim 4, wherein the resin further includes at least one of a silicone resin and an acrylic resin.

* * * * *